US009915891B2

(12) United States Patent
Yasui

(10) Patent No.: US 9,915,891 B2
(45) Date of Patent: Mar. 13, 2018

(54) DEVELOPING DEVICE WITH LIGHT REFLECTION THROUGH REGULATING MEMBER GAP

(71) Applicant: CANON KABUSHIKI KAISHA, Tokyo (JP)

(72) Inventor: Ryota Yasui, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/935,711

(22) Filed: Nov. 9, 2015

(65) Prior Publication Data

US 2016/0139535 A1 May 19, 2016

(30) Foreign Application Priority Data

Nov. 13, 2014 (JP) ..... 2014-230536

(51) Int. Cl.
*G03G 15/08* (2006.01)
*G03G 21/18* (2006.01)

(52) U.S. Cl.
CPC ..... *G03G 15/0812* (2013.01); *G03G 21/181* (2013.01)

(58) Field of Classification Search
CPC ..... G03G 2215/00987; G03G 15/0812
See application file for complete search history.

(56) References Cited

U.S. PATENT DOCUMENTS 4,937,627 A * 6/1990 Ozawa ..... G03G 15/0896 222/DIG. 1
7,650,101 B2 * 1/2010 Hosokawa ..... G03G 15/0822 399/254
2007/0092291 A1 * 4/2007 Suzuki ..... G03G 21/181 399/111

FOREIGN PATENT DOCUMENTS

| | | | | |
|---|---|---|---|---|
| JP | 63109960 | U | * | 7/1988 |
| JP | H01-273071 | A | | 10/1989 |
| JP | 05340723 | A | * | 12/1993 |
| JP | 06027803 | A | * | 2/1994 |
| JP | 11190935 | A | * | 7/1999 |
| JP | 2000105497 | A | * | 4/2000 |
| JP | 2000-330349 | A | | 11/2000 |
| JP | 2004279616 | A | * | 10/2004 |
| JP | 2007271770 | A | * | 10/2007 |

(Continued)

*Primary Examiner* — Minh Phan
*Assistant Examiner* — Leon W Rhodes, Jr.
(74) *Attorney, Agent, or Firm* — Fitzpatrick, Cella, Harper & Scinto

(57) ABSTRACT

A developing device includes a developing container for accommodating a developer, a rotatable developer carrying member for carrying and feeding the developer, and a layer thickness regulating member for regulating a layer thickness of the developer carried on the developer carrying member. The developer circulates between first and second chambers, which are partitioned by a partition wall. A rotatable feeding member feeds the developer in the first chamber, and a light-transmitting portion permits light transmission into a developing container. The light-transmitting portion is disposed at a developer carrying member side of the partition wall so that a light beam entering inside of the developing container is regularly reflected by a surface of a rotation shaft of the feeding member, and the regularly reflected light is emitted outside of the developing container through a gap between the developer carrying member and the layer thickness regulating member.

15 Claims, 4 Drawing Sheets

(56) References Cited

FOREIGN PATENT DOCUMENTS

| | | | | |
|---|---|---|---|---|
| JP | 2007322566 | A | * | 12/2007 |
| JP | 2009053311 | A | * | 3/2009 |
| JP | 2011-150102 | A | | 8/2011 |
| JP | 2011237487 | A | * | 11/2011 |
| JP | 2012-058309 | A | | 3/2012 |
| JP | 2012150168 | A | * | 8/2012 |
| JP | 2014-153546 | A | | 8/2014 |

* cited by examiner

DEVELOPING DEVICE WITH LIGHT REFLECTION THROUGH REGULATING MEMBER GAP

FIELD OF THE INVENTION AND RELATED ART

The present invention relates to a developing device in which a developer is carried on a developer carrying member and an electrostatic image on the developer carrying member is developed with the developer. Specifically, the present invention relates to a structure for measuring a gap between the developer carrying member and a layer thickness regulating member for regulating a thickness of the developer carried on the developer carrying member.

A conventional image forming apparatus of an electrophotographic type has been widely used as a copying machine, a printer, a plotter, a facsimile machine, a multifunction machine having a plurality of functions of these machines, and the like. In the image forming apparatus, a process for visualizing a developer image on a sheet by an image forming unit constituted by a developing unit (developing device) using the developer and a photosensitive drum unit or the like is employed. In the developing unit, a developing sleeve (developer carrying member) for supplying a developer to a photosensitive drum is provided and a fresh developer is always supplied onto the photosensitive drum by carrying the developer on an outer peripheral surface of the developing sleeve and rotating the developing sleeve.

It is said that in the developing unit, an amount of the developer coated on the developing sleeve has a great influence on an image quality. That is, there is a possibility that when a coating amount of the developer on the developing sleeve is small, a toner for developing the electrostatic image on the photosensitive drum becomes small in amount and thus image defect such a white dropout of the image generates. Further, there is a possibility that when the coating amount of the developer on the developing sleeve is large, the developer stagnates between the developing sleeve and the photosensitive drum and such an image defect that the toner on the photosensitive drum is transferred onto a whole surface and the toner is fused on the developing sleeve and thus an image density becomes thin. For that reason, a constitution in which a developing blade (layer thickness regulating member) is provided at a position opposing the developing sleeve and regulates an amount of the developer to be coated has become widespread. The developer coating amount has a great influence on a gap (spacing) between the developing sleeve and the developing blade, and therefore a dimensional tolerance of the developing sleeve, the developing blade and a positioning component (part) is required to have very high accuracy.

For that reason, an adjusting method in which, e.g., light is emitted from a light source toward the gap between the developing sleeve and the developing blade to measure a size of the gap by detecting reflected light thereof using a camera and then on the basis of a measurement result, the gap is adjusted has been known (Japanese Laid-Open Patent Application (JP-A) 2000-330349). According to this adjusting method, an actual component (part) can be positioned with no consideration of the dimension tolerance of the developing sleeve, the developing blade and the positioning component, so that the gap between the developing sleeve and the developing blade can be adjusted with high accuracy.

Further, a developing unit in which the developing sleeve and the developing blade are adjusted as a blade unit in an independent state and then the blade unit after the adjustment is incorporated to form the developing unit has been developed (JP-A 2011-150102). According to this developing unit, adjustment of a gap between the developing sleeve and the developing blade can be easily performed, so that assembling excellent also in operativity and maintenance property.

However, in the adjusting method in JP A 200 330349 described above, the reflected light from the developing sleeve and the developing blade is measured, and therefore measured accuracy largely depends on a surface property, surface treatment and a material for the developing sleeve and the developing blade. For this reason, there is a possibility that intensity or the like of the reflected light remarkably vary depending on a measuring condition and thus it is difficult to perform stable measurement, so that it was difficult to apply the adjusting method to the developing unit subjected to mass production.

In the developing unit disclosed in JP-A 2011-150102 described above, the gap adjustment between the developing sleeve and the developing blade is performed in an unfinished state, but the developing unit in the unfinished state is different in rigidity relative to the developing unit in a finished state. For that reason, an error generates between a gap between the developing sleeve and the developing blade when the developing unit in the finished state is mounted in the image forming apparatus and then is pressed and a gap between the developing sleeve and the developing blade when the developing unit is adjusted in the unfinished state.

SUMMARY OF THE INVENTION

A principal object of the present invention is to provide a developing device capable of realizing adjustment of a gap between a developer carrying member and a layer thickness regulating member after assembling with high accuracy.

According to an aspect of the present invention, there is provided a developing device comprising: a developing container for accommodating a developer; an upper cover portion for covering a top surface of the developing container; a developer carrying member, rotatably supported by the developing container, for carrying and feeding the developer inside the developing container; a layer thickness regulating member, provided on the developing container, for regulating a layer thickness of the developer carried on the developer carrying member; a feeding member, rotatably provided in the developing container at a position opposing the developer carrying member, for feeding the developer in the developing container; and a light-transmitting portion, provided in the upper cover portion, for permitting light transmission to an inside of the developing container, wherein the light-transmitting portion is disposed at a position where when a light beam entering the inside of the developing container is regularly reflected by a surface of a rotation shaft of the developing container, the regularly reflected light is emitted to an outside of the developing container through a gap between the developer carrying member and the layer thickness regulating member.

These and other objects, features and advantages of the present invention will become more apparent upon a consideration of the following description of the preferred embodiments of the present invention taken in conjunction with the accompanying drawings.

DESCRIPTION OF THE EMBODIMENTS

In the following, an embodiment of the present invention will be specifically described with reference to FIGS. 1 to 5. In this embodiment, as an example of an image forming apparatus, a full color printer of a tandem type is described. However, the image forming apparatus in the present invention is not limited to the full color printer of the tandem type but may also be an image forming apparatus of another type. Further, the image forming apparatus is not limited to the full color image forming apparatus, but may also be an image forming apparatus for forming a monochromatic image or a mono color image.

Figure 1:
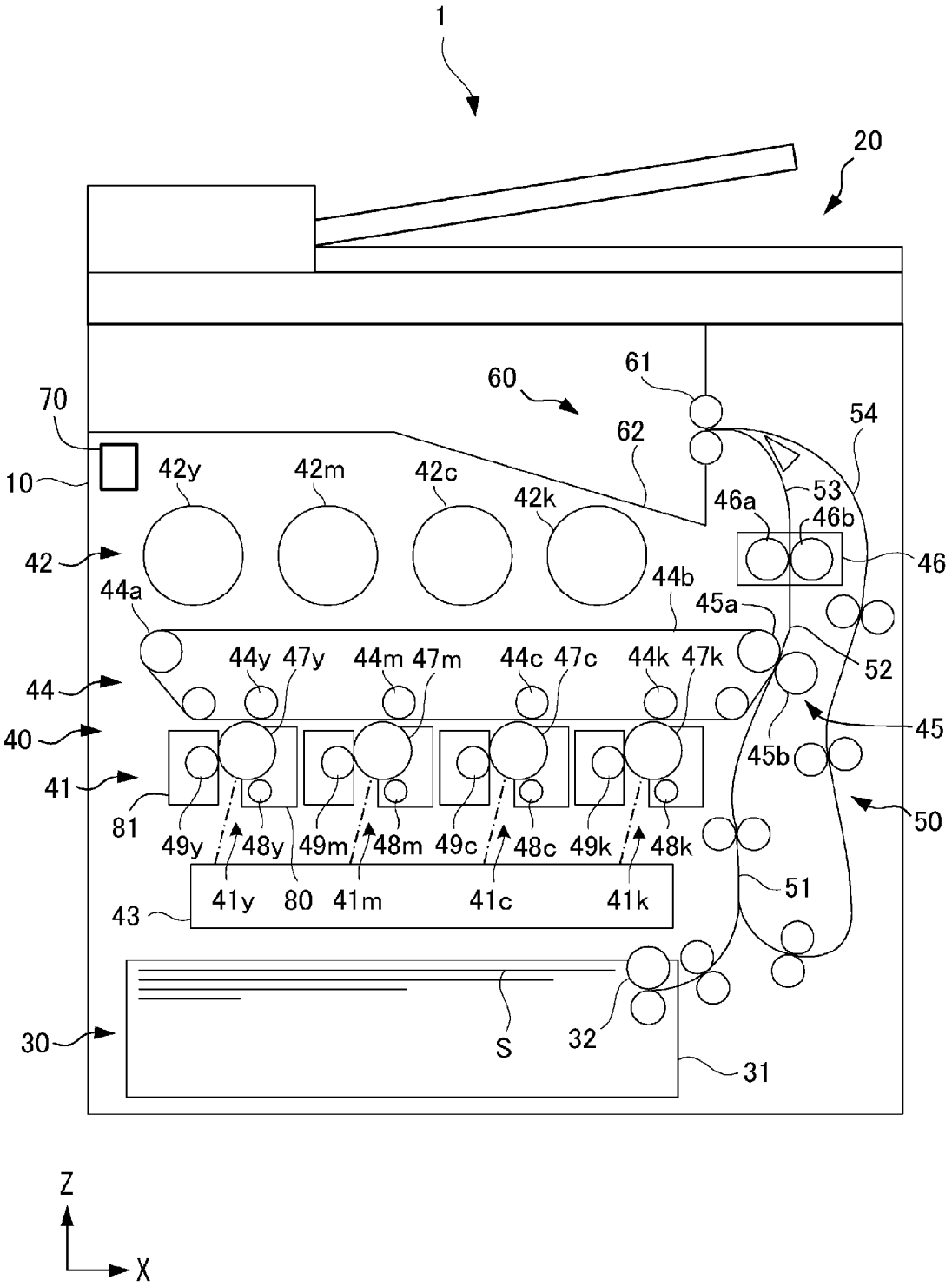
FIG. 1 is a schematic sectional view of an image forming apparatus in an embodiment of the present invention.

As shown in FIG. 1, an image forming apparatus 1 includes an image forming apparatus main assembly 10. Further, the apparatus main assembly 10 includes an image reading portion 20, a sheet feeding portion 30, an image forming portion 40, a sheet feeding portion 50, a sheet discharging portion 60, a controller 70. On a sheet S as a recording material, a toner image is to be formed, and specific examples of the sheet S may include plain paper, a synthetic resin material sheet as a substitute for the plain paper, thick paper, a sheet for an overhead projector, and the like.

The image reading portion 20 is provided at an upper portion of the apparatus main assembly 10. The image reading portion 20 includes an unshown platen glass as an original carriage, an unshown light source for irradiating an original placed on the platen glass with light, an unshown image sensor for converting reflected light into a digital signal, and the like.

The sheet feeding portion 30 is disposed at a lower portion of the apparatus main assembly 10, and includes a sheet cassette 31 for stacking and accommodating the sheet S and includes a feeding roller 32. The sheet feeding portion 30 feeds the sheet S to the image forming portion 40.

The image forming portion 40 includes an image forming unit 41, a toner bottle 42, a laser scanner 43, an intermediary transfer unit 44, a secondary transfer portion 45 and a fixing device 46 and effects image formation.

The image forming unit 41 includes four image forming units 41*y*, 41*m*, 41*c* and 41*k* for forming toner images of four colors of yellow (y), magenta (m), cyan (c) and black (k), respectively. Each of the image forming units is detachably mountable to the apparatus main assembly 10 by a user. For example, the image forming unit 41*y* includes a photosensitive drum 47*y* as an image bearing member on which the toner image is to be formed, a charging roller 48, a developing sleeve (developer carrying member) 49*y*, an unshown drum cleaning blade, a toner, and the like. To the image forming unit 41*y*, the toner is supplied from the toner bottle 42*y* in which the toner is filled. Other image forming units 41*m*, 41*c* and 41*k* have the same structure as that of the image forming unit 41*y* except that colors of toners accommodated therein are different from the color of the toner in the image forming unit 41*y*, and therefore will be omitted from detailed description.

For example, the image forming unit 41*y* includes a photosensitive (member) unit 80 and a developing unit (developer carrying member) 81. The photosensitive unit 80 includes the photosensitive drum 47*y*, the charging roller 48*y* and the unshown drum cleaning blade of the image forming unit 41*y*. The photosensitive drum 47*y* is exposed upward and is contactable to an intermediary transfer belt 44*b*. The structure of this photosensitive unit 80 is the same as the structure of a conventionally known photosensitive unit, and therefore will be omitted from detailed description. A structure of the developing unit 81 will be described later.

The laser scanner 43 is an exposure means for exposing surfaces of the photosensitive drums 47*y*, 47*m*, 47*c* and 47*k* to light to form electrostatic latent images on the surfaces of the photosensitive drums 47*y*, 47*m*, 47*c* and 47*k*.

The intermediary transfer unit 44 is disposed above the image forming unit 41. The intermediary transfer unit 44 includes a driving roller 44*a*, a plurality of primary transfer rollers 44*y*, 44*m*, 44*c* and 44*k*, and the intermediary transfer belt 44*b* wound around there rollers. The primary transfer rollers 44*y*, 44*m*, 44*c* and 44*k* are disposed opposed to the photosensitive drums 47*y*, 47*m*, 47*c* and 47*k*, respectively, and are disposed in contact with the intermediary transfer belt 44*b*. A positive transfer bias is applied to the intermediary transfer belt 44*b* by the primary transfer rollers 44*y*, 44*m*, 44*c* and 44*k*, whereby toner images having a negative polarity are superposedly transferred successively from the photosensitive drums 47*y*, 47*m*, 47*c* and 47*k* onto the intermediary transfer belt 44*b*. As a result, a full-color image is formed on the intermediary transfer 44*b*.

The secondary transfer portion 45 includes a secondary transfer inner roller 45*a* and a secondary transfer outer roller 45*b*. By applying a positive secondary transfer bias to the secondary transfer outer roller 45*b*, the full-color image formed on the intermediary transfer belt 44*b* is transferred onto the sheet S. The secondary transfer inner roller 45*a* stretches the intermediary transfer belt 44*b* at an inside of the intermediary transfer belt 44*b*, and the secondary transfer outer roller 45*b* is provided at a position opposing the secondary transfer inner roller 45*a* via the intermediary transfer belt 44*b*.

The fixing device 46 includes a fixing roller 46*a* and a pressing roller 46*a*. The sheet S is nipped and fed between the fixing roller 46*a* and the pressing roller 46*b*, so that the toner image transferred on the sheet S is pressed and heated to be fixed on the sheet S. The fixing device 46 constitutes a single unit and is insertable into and demountable from the apparatus main assembly 10.

The sheet feeding portion 50 feeds the sheet S, fed from the sheet feeding portion 30, from the image forming portion 40 to the sheet discharging portion 60, and includes a pre-secondary transfer feeding path 51, a pre-fixing feeding path 52, a post-fixing feeding path 53, a discharging path 54, and a (re-)feeding path 45.

The sheet discharging portion 60 includes a discharging roller pair 61 provided in a downstream side of the discharging path 53 and includes a discharge tray 62 provided in a downstream side of the discharging roller pair 61. The discharging roller pair 61 feeds the sheet S, fed from a nip along the discharging path 53, to discharge the sheet S onto the discharge tray 62. A space between the image reading portion 20 and the discharge tray 62 constitutes an inner space portion.

The controller 70 is constituted by a computer and, e.g., includes CPU, ROM for storing a program for controlling respective portions, RAM for temporarily storing data, and an input-and-output circuit (I/F) for inputting and outputting signals relative to an external device. The CPU is a microprocessor for effecting entire control of the image forming apparatus 1 and is a principal part of a system controller. The CPU is connected via the input-and-output circuit with each of the sheet feeding portion 30, the image forming portion 40, the sheet feeding portion 50 and the sheet discharging portion 60, and transfers signals with the respective portions and controls operations of the respective portions. Further, the controller 70 enables an operation and setting by the user through an instruction from an unshown computer connected with the apparatus main assembly 10, an operation of an unshown operating panel or the like.

An image forming operation in the image forming apparatus 1 constituted as described above will be described.

When the image forming operation is started, first, the photosensitive drums 47*y*, 47*m* 47*c* and 47*k* are rotated, and the surfaces thereof are electrically charged by the charging rollers 48*y*, 48*m*, 48*c* and 48*k*, respectively. Then, the laser scanner 43 emits, on the basis of image information, laser light toward the surface of each of the photosensitive drums 47*y*, 47*m*, 47*c* and 47*k*, so that an electrostatic latent image is formed on the surface of each of the photosensitive drums 47*y*, 47*m*, 47*c* and 47*k*. The toner is deposited on the electrostatic latent image to develop (visualize) the electrostatic latent image into a toner image, and then the toner image is transferred onto the intermediary transfer belt 44*b*.

On the other hand, in parallel to such a toner image forming operation, the embodiment roller 32 is rotated to feed the uppermost sheet S in a sheet cassette 31 while separating the sheet S. Then, the sheet S is fed to the secondary transfer portion 45 via the pre-secondary transfer feeding path 51 by being timed to the toner image on the intermediary transfer belt 44*b*. Then, the toner image is transferred from the intermediary transfer belt 44*b* onto the sheet S, and the sheet S is fed into the fixing device 46, in which the (unfixed) toner image is heated and pressed, thus being fixed on the surface of the sheet S. The sheet S is discharged by the discharging roller pair 61, so that the sheet S is stacked on the discharge tray 62.

The developing unit 81 will be specifically described using FIGS. 2 to 5. In this embodiment, as shown in each of the figures, a toner embodiment direction, i.e., a rotational direction of the developing sleeve 49*y* is R direction, and a longitudinal direction of the developing sleeve 49*y* perpendicular to the R direction is Y direction (axial direction, width direction). When the image forming apparatus 1 is viewed from a front side, a left-right direction is X direction, and an up-down direction perpendicular to the X direction and the Y direction is Z direction.

Figure 2:
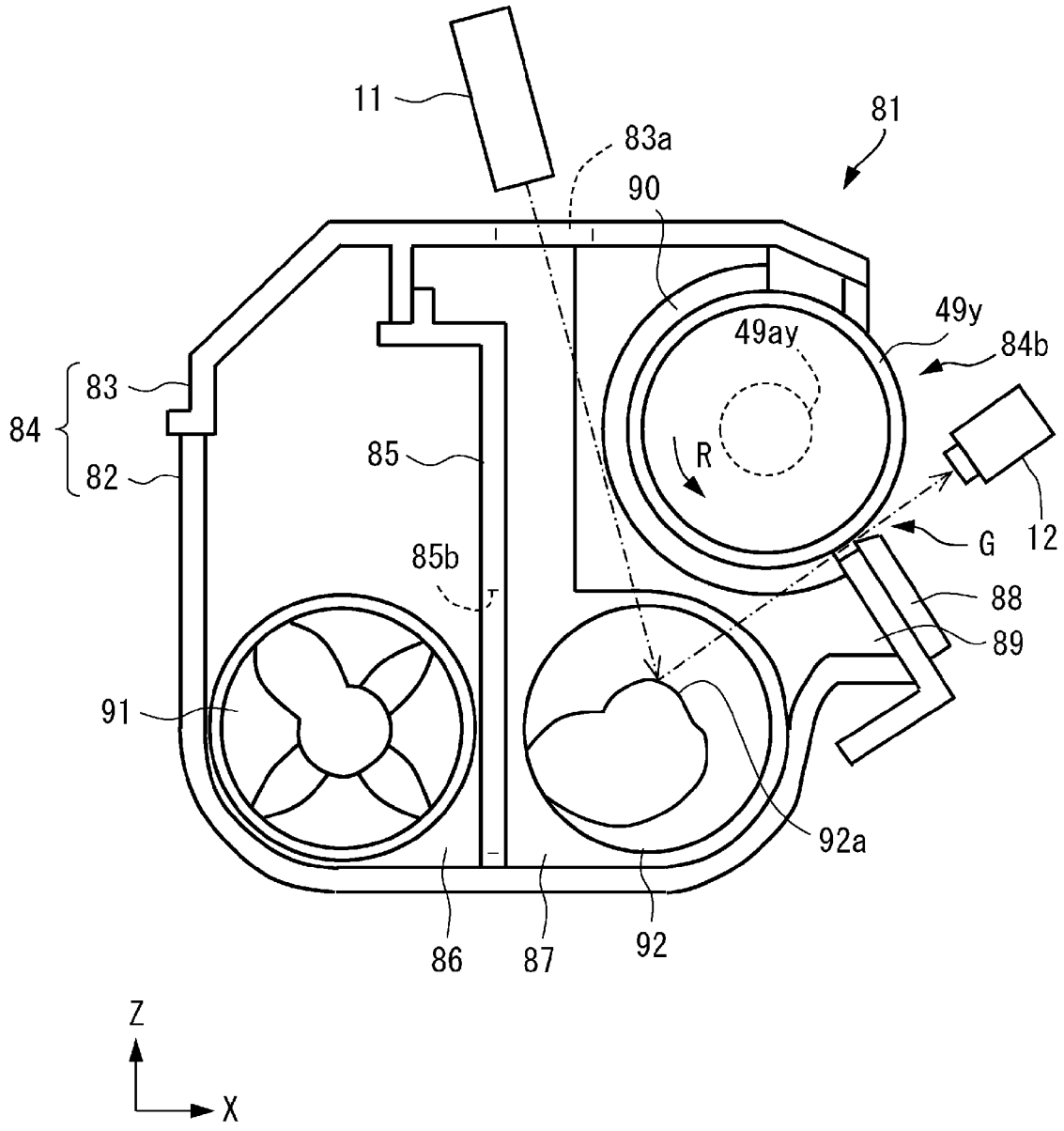
FIG. 2 is a schematic sectional view of a developing unit in the embodiment.
Figure 3:
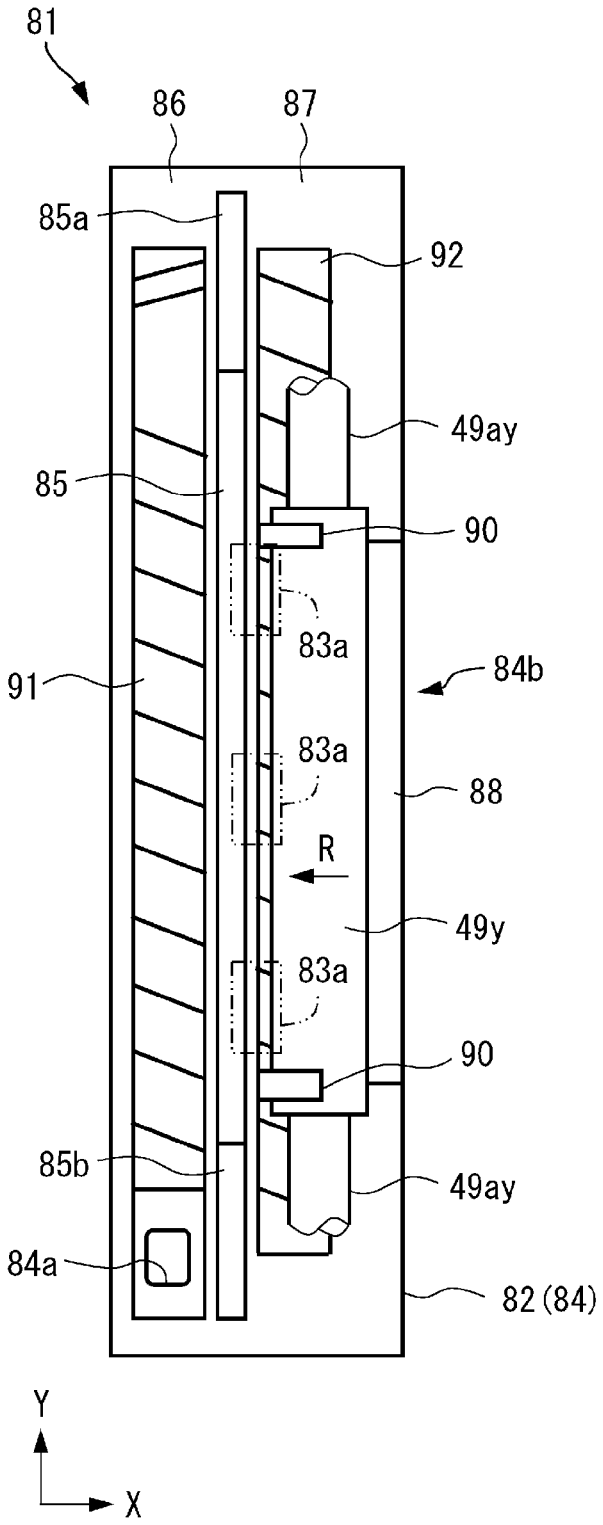
FIG. 3 is a plan view of the developing unit in the embodiment in a state in which a developing cover is demounted.

As shown in FIGS. 2 and 3, the developing unit 81 includes a developing container 84 consisting of a container body 82 as a casing and a container cover 83 mounted at an upper portion of the container body 82. The container body 82 is mountable to the apparatus main assembly and rotatably holds the developing sleeve 49*y*, and is constituted to accommodate the developer therein. The container cover 83 is mounted at an upper portion of the container body 82 and covers at least a part of the developing sleeve 49*y*. A detailed structure of the container body 83 will be described later. The developing container 84 includes a partition wall 85 therein extending in a longitudinal direction which is the Y direction, and by the partition wall, an inside of the developing container 84 is partitioned into a stirring chamber 86 and a developing chamber 87. The stirring chamber 86 and the developing chamber 87 communicate with each other through communicating portions 85*a* and 85*b* formed at end portions of the partition wall 85 with respect to the Y direction.

The developing unit 81 is positioned relative to the apparatus main assembly 10 and the photosensitive unit while being urged. For this reason, a material for the developing container 84 may preferably have high rigidity, and in this embodiment, a material for the container body 82 is made higher in rigidity than a material for the container cover 83. That is, Young's modulus of the material for the container body 82 is made larger than Young's modulus of the material for the container cover 83.

In the stirring chamber 86, a first feeding screw 91 is rotatably accommodated and stirs the toner, together with a carrier, supplied from the toner bottle 42*y* (FIG. 1) through a supply opening 84*a*, thus supplying the developer to the developing chamber 87 through one communicating portion 85*a*. In the developing chamber 87, a second feeding screw (reflecting portion, feeding member) 92 provided rotatably in parallel to the first feeding screw 91 and the developing sleeve 49*y* and the like are accommodated. The second feeding screw 92 feeds the developer (toner and carrier), supplied through one communicating portion 85*a*, in an opposite direction to a developer feeding direction of the first feeding screw 91 in the developing chamber 87, and supplies the developer to the stirring chamber 86 through the other communicating portion 85*b*. As a result, the developer is circulated along a circulating path through the two communicating portions 85*a* and 85*b* each for connecting the stirring chamber 86 and the developing chamber 87.

The developing sleeve 49*y* includes a rotation shaft 49*ay* rotatably supported by the container body at each of end portions thereof, and is rotatably provided so that a part of an outer peripheral surface thereof is exposed toward the photosensitive drum 47*y* (FIG. 1) through an opening 84*b* formed in the developing container 84. At a lower portion of the opening 84*b*, a developing blade (layer thickness regulating member) 88 is provided along the developing sleeve 49*y*. The developing blade 88 is provided on the container body 82 by a gap adjusting mechanism 93 (FIG. 4) so as to provide a predetermined gap (spacing) G with the developing sleeve 49*y*. The gap adjusting mechanism 83 will be described later.

The developing sleeve 49*y* carries and feeds the developer to the photosensitive drum 47*y* by being rotationally driven in the R direction. An unshown magnet fixed in the developing container 84 is accommodated inside the developing sleeve 49*y*. The developer stirred and fed in the stirring chamber 86 and the developing chamber 87 is electrically charged to a negative polarity for the toner and a positive polarity for the carrier, so that the developer is carried and fed on the developing sleeve 49*y* by a magnetic force of the magnet. As a result, the developer carried on the developing sleeve 49*y* is fed to the photosensitive drum 47*y* in a state in which a layer thickness of the developer is regulated by the developing blade 88.

The developing unit 81 includes a sealing member 90 at each of end portions of the developing sleeve 49*y*. The sealing member 90 is fixed on a supporting portion 89 for the container body 82 and performs sealing so as to prevent the developer between itself and the developing sleeve 49*y* from leaking to an outside with respect to the width direction.

Figure 4:
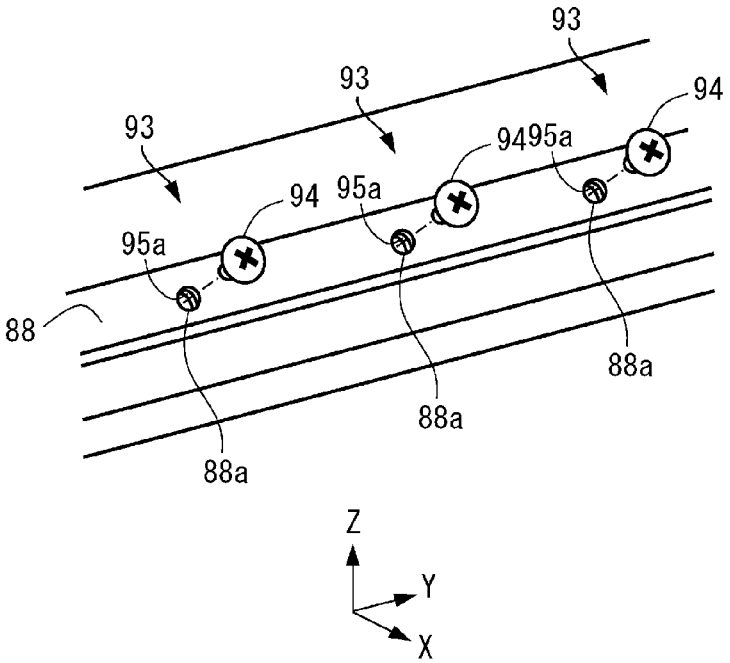
FIG. 4 is a perspective view of a gap adjusting mechanism for the developing unit in the embodiment.
Figure 5:
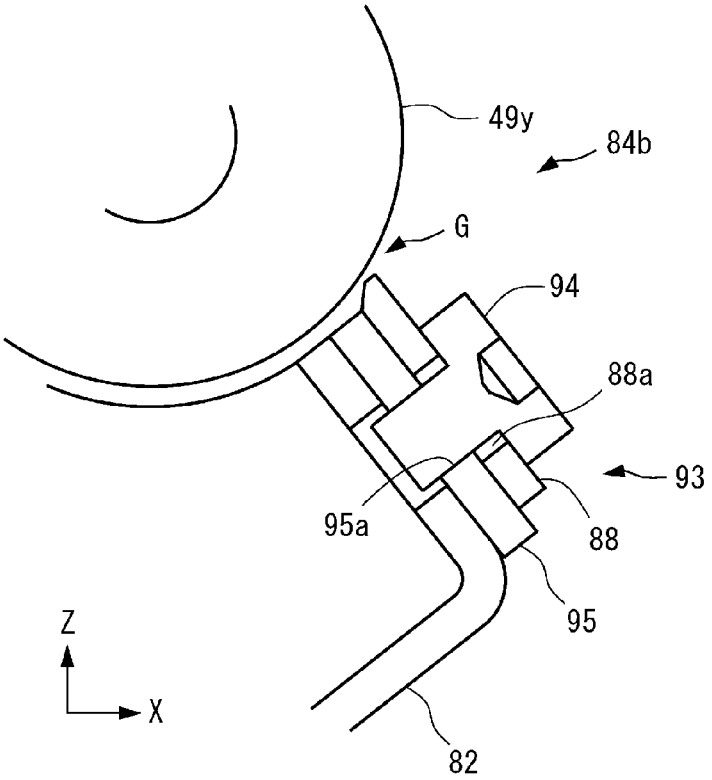
FIG. 5 is a sectional view of the gap adjusting mechanism for the developing unit in the embodiment.

As shown in FIGS. 4 and 5, the gap adjusting mechanism 93 includes a plurality of, e.g., three screw members 94 and a supporting plate 95 fixed on the container body 82. The supporting plate 95 is fixed by screwing or the like along a lower edge portion of the opening 84*a* of the container body 82. The supporting plate 95 is provided with screw holes 95*a* through which the screw members are threadably engaged. The developing blade 88 is provided with a plurality of adjusting holes 88*a* consisting of through holes. Each of the adjusting holes 88*a* is an elongated hole having a long diameter longer than a diameter of an associated screw portion of the screw member 94. The long diameter portion is disposed perpendicular to the longitudinal direction (Y direction) of the developing blade 88. Accordingly, as shown in FIG. 5, the screw member 94 is penetrated through the adjusting hole 88*a* of the developing blade 88 and is fastened in the screw hole 95*a* of the supporting plate 95, so that the developing blade 88 is fixed. By loosening the screw member 94, the developing blade 88 is movable toward and away from the developing sleeve 49*y*, so that the position of the developing blade 88 is appropriately adjustable. After the position of the developing blade 88 is determined, the screw member 94 is fastened, so that the position of the developing blade 88 is finally determined (fixed).

The container cover 83 of the developing unit 81 described above will be described in detail using FIGS. 2 and 3. In this embodiment, the container cover 83 is formed of a transparent synthetic resin material through, e.g., injection molding. As shown in FIG. 3, the container cover 83 is provided with light-transmitting portions 83*a* as window portions at three positions along the Y direction of the container body 83. For example, a light-transmitting property of each of the transmitting portions 83*a* is made higher than a light-transmitting property of other portions by subjecting a portion corresponding to the transmitting portion 83*a* of a metal mold for forming the container body 83 to mirror-like finishing (process).

As shown in FIG. 2, in the case where a light source 11 is provided outside the transmitting portion 83*a* and the transmitting portion 83*a* is irradiated with light, the light is reflected regularly and irregularly (diffusedly) by the surface of a center shaft 92*a* of the second feeding screw 92. Then, the reflected light regularly reflected by the surface of the center shaft 92*a* passes through a gap G and thus is emitted to an outside of the developing container 84. That is, the second feeding screw 92 regularly reflects the light beam emitted from the outside of the developing container 84 and entering the inside of the developing container 84 through at least a part of the transmitting portion 83*a*, so that the light beam goes out to the outside of the developing container 84 through the gap G. Further, the transmitting portion 83*a*, the developing sleeve 49*y*, the developing blade 88 and the second feeding screw 92 are disposed so that the light beam which passes through at least a part of the transmitting portion 83*a* and which is regularly reflected by the second feeding screw 92 goes to the outside of the developing container 84 through the gap G. Then, the light beam which exits to the outside of the developing container 84 through the gap G is photographed by a camera 12 disposed opposed to the outside of the gap G, so that a magnitude (length) of the gap G can be measured.

An optical path of the reflected light regularly reflected by the surface of the center shaft 92*a* is a rectilinear line parallel to a tangential line of the developing sleeve 49*y* at the closest position between the developing sleeve 49*y* and the developing blade 88 as seen from the Y direction. In this case, an amount of light passing through the gap G becomes maximum, and therefore measurement accuracy of the length of the gap G can be improved. However, the optical path of the reflected light regularly reflected by the surface of the center shaft 92*a* is not limited to the above-described optical path, but may also include an optical path within an inclination range of a predetermined angle including the above-described optical path as a center, for example. In this case, the inclination range can be, e.g., 5°-22°, preferably be about 13.5°±6.75°. When the optical path falls within such an inclination range, it is possible to sufficiently ensure the amount of light passing through the gap G, and therefore it is possible to improve the measurement accuracy of the length of the gap G.

A gap adjusting procedure in the developing unit 81 described above will be described with reference to FIGS. 2 to 5.

As shown in FIG. 3, after the developing unit 81 is assembled, a phase of the second feeding screw 92 is adjusted so that the center shaft 92*a* of the second feeding screw 92 is positioned below the three transmitting portions 83*a*. That is, when the blade of the second feeding screw 92 is positioned below the transmitting portions 83*a*, there is a possibility that the light beam cannot be regularly reflected toward the gap G, and therefore such a situation is obviated.

Then, as shown in FIG. 2, three light sources 11 are provided correspondingly to the three transmitting portions 83*a*, respectively, and each of the transmitting portions 83*a* is irradiated with the light beam. The light beam emitted from each of the light sources 11 is reflected regularly and irregularly by the center shaft 92*a* of the second feeding screw 92, and the regularly reflected light passes through the gap G. By measuring the light beam passing through the gap G using the camera 12, the length of the gap G can be calculated using a known method.

As a result of the measurement, in the case where there is a need to adjust the length of the gap G, as shown in FIG. 5, the screw member 94 of the gap adjusting mechanism 93 is loosened to adjust the position of the developing blade 88, and then is fastened again. Then, using the camera 12 again, the length of the gap G is measured. In this way, by appropriately repeating the measurement and the adjustment, the developing blade 88 can be disposed at a desired position.

As described above, according to the developing unit 81 in this embodiment, the light caused to pass through the transmitting portions 83*a* from the outside of the developing container 84 and then to enter the inside of the developing container 84 is regularly reflected by the enter shaft 92*a* of the second feeding screw 92. This regularly reflected light exits as the reflected light to the outside of the developing container 84 through the gap G. For this reason, the gap G can be measured with high accuracy by detecting the exiting reflected light, so that the adjustment of the gap G can be realized with high accuracy after the assembling of the developing unit 81.

Further, according to the developing unit 81 in this embodiment, the gap adjusting mechanism 93 capable of adjusting the disposing position of the developing blade 88 relative to the developing sleeve 88 in the developing container 84 is provided. For this reason, on the basis of a result of the measurement of the gap G, the gap G can be adjusted, and therefore it is possible to easily obtain the developing unit 81 having a high-precision gap G.

Further, according to the developing unit 81 in this embodiment, the light beam passing through the transmitting portions 83*a* is reflected by the second feeding screw 92, and therefore there is no need to provide a separate member for reflection, so that it is possible to prevent upsizing of the developing unit 81.

Further, according to the developing unit 81 in this embodiment, the transmitting portions 83*a* are molded integrally with a part of the container cover 83, and therefore cost reduction can be realized compared with the case where an entirety of the container cover 83 is formed as a light-transmitting member. Further, compared with the case where light-transmitting holes are formed at a part of the container cover 83 and separate light-transmitting members are engaged in the light-transmitting holes, it is possible to reduce a manufacturing cost of the container cover 83.

In the above-described embodiment, the case where the transmitting portions 83*a* are formed at a part of the container cover 83 was described, but the present invention is not limited thereto. For example, the entirety of the container cover 83 may also be formed as the light-transmitting portion 83*a*. In this case, compared with the case where the transmitting portions 83*a* are formed at the part of the container cover 83, it is possible to improve a degree of freedom of irradiation position of the light source 11. Or, a light-transmitting hole is formed at a part of the container cover 83 and then a separate light-transmitting member may also be engaged in the light-transmitting hole. In this case, there is no need to use a transparent material as the material for the container cover 83, and therefore a degree of freedom of the material can be improved, and the container cover 83 can be formed of a high-rigidity material, for example.

Further, in this embodiment, the case where the light beam passing through the transmitting portions is regularly reflected by the center shaft 92*a* of the roller feeding screw 92 was described, but the present invention is not limited thereto. For example, the light beam may also be regularly reflected by the partition wall 85 depending on arrangement of the transmitting portions 83*a*, the developing sleeve 49*y*, the developing blade 88 and the second feeding screw 92. Alternatively, a separate member for reflection may also be provided.

Further, in this embodiment, the case where the gap adjusting mechanism 93 is a mechanism including the screw member 94 and the supporting plate 95 was described, but the present invention is not limited thereto. That is, it is possible to use a known or new appropriate adjusting mechanism.

According to the present invention, the light beam which passes through the transmitting portion from the outside of the developing container and which then enters the inside of the developing container is regularly reflected by the reflecting portion and then goes out as the reflected light to the outside of the developing container through the gap (spacing) between the developer carrying member and the layer thickness regulating member. For this reason, by detecting the exiting reflected light, it is possible to measure the gap between the developer carrying member and the layer thickness regulating member with high accuracy. Accordingly, the adjustment of the gap between the developer carrying member and the layer thickness regulating member can be realized with high accuracy after the developing device is assembled.

While the invention has been described with reference to the structures disclosed herein, it is not confined to the details set forth and this application is intended to cover such modifications or changes as may come within the purpose of the improvements or the scope of the following claims.

This application claims the benefit of Japanese Patent Application No. 2014-230536 filed on Nov. 13, 2014, which is hereby incorporated by reference herein in its entirety.

What is claimed is:

1. A developing device comprising:

a container for accommodating a developer including toner and a carrier;

a developer carrying member, rotatably supported by said container, for carrying the developer;

a developer regulating member, provided on said container, for regulating an amount of the developer carried on said developer carrying member;

a first chamber, opposing said developer carrying member, for supplying the developer to said developer carrying member;

a second chamber for circulating the developer between itself and said first chamber;

a partition wall for partitioning said first chamber and said second chamber;

a first feeding member, rotatably provided in said first chamber, for feeding the developer in said first chamber in a first feeding direction; and a second feeding member, rotatably provided in said second chamber, for feeding the developer in said second chamber in a second direction opposite to the first feeding direction;

a cover for covering an opening of said container so that part of an outer peripheral surface of said developer carrying member is covered over an entire longitudinal region of said developer carrying member; and a light-transmitting portion, provided in said cover, for permitting light transmission to an inside of said container, wherein said light-transmitting portion is provided at least in a cover side closer to said developer carrying member than said partition wall is so that a light beam entering the inside of said container is reflected by a surface of said first feeding member, the reflected light being emitted to an outside of said container through a gap between said developer carrying member and said developer regulating member.

2. A developing device according to claim 1, further comprising an adjusting mechanism capable of adjusting a disposing position of said developer regulating member on said container relative to said developer carrying member.

3. A developing device according to claim 1, wherein the light beam regularly reflected from the surface of a rotation shaft of said first feeding member falls within an inclination range of ±6.75° with respect to a center rectilinear line parallel to a tangential line of said developer carrying member at a closest position between said developer carrying member and said developer regulating member as seen from an axial direction of said developer carrying member.

4. A developing device according to claim 1, wherein said light-transmitting portion is provided at a plurality of positions with respect to the axial direction of said developer carrying member.

5. An developing device according to claim 1, wherein said light-transmitting portion is provided at end portions and a central portion of said developer carrying member with respect to the axial direction of said developer carrying member.

6. A developing device according to claim 1, wherein said container is formed of a material having a non-light-transmitting property.

7. A developing device according to claim 1, wherein a free end of said developer regulating member opposing said developer carrying member is disposed below a center of said developer carrying member with respect to the direction of gravity.

8. A developing device according to claim 1, wherein the light beam entering the inside of said container is regularly reflected by a surface of a rotation shaft of said first feeding member.

9. A developing device comprising:

a container for accommodating a developer including toner and a carrier;

a developer carrying member, rotatably supported by said container, for carrying the developer;

a developer regulating member, provided on said container, for regulating an amount of the developer carried on said developer carrying member;

a first chamber, opposing said developer carrying member, for supplying the developer to said developer carrying member;

a second chamber for circulating the developer between itself and said first chamber;

a partition wall for partitioning said first chamber and said second chamber;

a first feeding member, rotatably provided in said first chamber, for feeding the developer in said first chamber in a first feeding direction;

a second feeding member, rotatably provided in said second chamber, for feeding the developer in said second chamber in a second direction opposite to the first feeding direction;

a cover, made of a transparent resin, for covering an opening of said container so that part of an outer peripheral surface of said developer carrying member is covered over an entire longitudinal region of said developer carrying member; and wherein light entering the inside of said container is regularly reflected by a surface of a rotation shaft of said first feeding member.

10. A method of adjusting a gap between a developer carrying member and a developer regulating member in a developing device, with the developing device including:

a container for accommodating a developer including toner and a carrier; a developer carrying member, rotatably supported by the container, for carrying the developer; a developer regulating member, provided on the container, for regulating an amount of the developer carried on the developer carrying member; a first chamber, opposing the developer carrying member, for supplying the developer to the developer carrying member; a second chamber for circulating the developer between itself and the first chamber; a partition wall for partitioning the first chamber and the second chamber; a first feeding member, rotatably provided in the first chamber, for feeding the developer in the first chamber in a first feeding direction; a second feeding member, rotatably provided in the second chamber, for feeding the developer in the second chamber in a second direction opposite to the first feeding direction; a cover for covering an opening of the container so that part of an outer peripheral surface of the developer carrying member is covered over an entire longitudinal region of the developer conveying member; and a light-transmitting portion, provided in the cover, for permitting light transmission to an inside of the container, said adjusting method comprising:

a first step of irradiating the first feeding member with a light beam through the light-transmitting portion; and a second step of adjusting the gap on the basis of reflected light that is reflected from the first feeding member and is emitted to an outside of the container through the gap.

11. An adjusting method according to claim 10, further comprising a third step of detecting the reflected light, wherein a position of the developer regulating member relative to the developer carrying member is based on a detection result of the reflected light.

12. An adjusting method according to claim 10, wherein the light beam regularly reflected from a surface of a rotation shaft of the first feeding member falls within an inclination range of ±6.75° with respect to a center rectilinear line parallel to a tangential line of the developer carrying member at a closest position between the developer carrying member and the developer regulating member as seen from an axial direction of the developer carrying member.

13. An adjusting method according to claim 10, wherein the reflected light is a regularly reflected light that is regularly reflected by a surface of a rotation shaft of the first feeding member.

14. An adjusting method according to claim 10, wherein the gap is adjusted at each of positions with respect to an axial direction of the developer carrying member.

15. An adjusting method according to claim 10, wherein the gap is adjusted at each of end portions and a central portion of the developer carrying member with respect to an axial direction of the developer carrying member.

* * * * *